US006095950A

United States Patent [19]

Katz

[11] Patent Number: 6,095,950

[45] Date of Patent: Aug. 1, 2000

[54] PLAYGROUND EQUIPMENT COMPRISING UPRIGHT POSTS

[75] Inventor: Steen Katz, Ringe, Denmark

[73] Assignee: Kompan A/S, Ringe, Denmark

[21] Appl. No.: 09/082,386

[22] Filed: May 20, 1998

[30] Foreign Application Priority Data

Jun. 2, 1997 [DK] Denmark ..... 00221/97

[51] Int. Cl.[7] ..... A63B 17/00

[52] U.S. Cl. ..... 482/35; 482/34; 482/37; 482/38

[58] Field of Search ..... 482/23, 33–38; D21/814, 823, 826, 827; 182/194

[56] References Cited

U.S. PATENT DOCUMENTS

| | | | |
|---|---|---|---|
| D. 366,512 | 1/1996 | Ziegler, Jr. et al. | D21/823 |
| 4,084,812 | 4/1978 | Melrose et al. | 482/35 |
| 4,159,113 | 6/1979 | Callecod | 482/36 |
| 4,278,250 | 7/1981 | Baynes et al. | 482/36 |
| 4,340,217 | 7/1982 | Gillis | 482/35 |
| 4,497,484 | 2/1985 | West . | |
| 5,326,328 | 7/1994 | Robinson | 482/35 |
| 5,330,400 | 7/1994 | Huberman . | |

FOREIGN PATENT DOCUMENTS

| | | | |
|---|---|---|---|
| 2 713 940 | 12/1993 | France . | |
| 89 11 820 | 1/1990 | Germany . | |
| 91 13 205 | 1/1992 | Germany . | |
| 626476 | 7/1949 | United Kingdom . | |
| 88/07885 | 10/1988 | WIPO | 482/35 |

OTHER PUBLICATIONS

European Search Report EP 98 61 0013 dated Sep. 22, 1998.

*Primary Examiner*—John Mulcahy
*Assistant Examiner*—Victor Hwang
*Attorney, Agent, or Firm*—William J. Sapone, Esq.; Nims, Howes, Collison, Hansen & Lackert

[57] ABSTRACT

To stimulate and engage children, especially older children, playground equipment is disclosed which provides a suitable challenge, by consisting of three columns which are arranged in a triangular cross-sectional form which tapers inwardly. The columns are assembled with connection tubes at the top and possibly also further down to provide a stable and very strong construction which supports various accessories elements such as ropes, climbing walls, cross-beams, etc. A spherical assembly bracket with through holes is mounted on a column and used in the assembly and suspension of the accessory elements.

27 Claims, 7 Drawing Sheets

PLAYGROUND EQUIPMENT COMPRISING UPRIGHT POSTS

THE KNOWN TECHNIQUE

The invention concerns playground equipment comprising upright posts to which elements such as laddders, ropes, platforms etc. are secured.

Playground equipment of this kind is known in many different configurations. It is normally some form or other of post construction on which there are mounted platforms, towers, ladders, slides, ropes etc., and the object of which is to provide children with possibilities of crawling both up and down in different ways.

Such items of playground equipment are configured to suit smaller children, and therefore larger children do not find sufficient challenge in playing on such known equipment.

THE OBJECT OF THE INVENTION

It is the object of the invention to remedy this disadvantage of the known items of playground equipment, and this is achieved according to the invention with playground equipment where the posts comprise three columns in the form of metal tubes, each of which is anchored at the bottom at a mutual distance, and where the posts extend upwards and sloping inwards to form a smaller mutual distance at the top.

The use of metal tubes provides completely new possibilities, partly by giving the equipment a metal "look" which attracts larger children, and partly that from a purely constructive point of view it provides possibilities of building up relatively higher equipment which for larger children offers better challenges.

Moreover, the truncated tetrahedron-like column construction provides a hitherto-unknown good stability and herewith a high degree of safety, not least because of the sloping outwards of the side surfaces towards the base.

By connecting the columns with metal tubes at the top and possibly also further down, a very stable, strong and yet light construction is achieved on which it is suitable to mount various recreational equipment such as ladders, ropes etc.

By providing a column with a plate element on the outer side along the column, a wall-plate can be formed on which to mount various equipment.

By letting this equipment consist of projections in the form of knobs or the like, these can serve as under-support for a crawling person.

By mounting plates in the space between the columns, platforms can be built which can either be horizontal or sloping.

By mounting a beam on a fixed plate up in the tower, and letting the beam slope downwards to the base, the beam can serve as a crawling beam.

By mounting a metal ladder with its sidepieces at the top secured to a column, while the sidepieces below extend in the "normal" manner, a crawling ladder with great challenges is achieved.

By using an assembly bracket or assembly element in the shape of a ring which can be mounted on the column, and which has threaded holes, this ring can serve both as a retaining ring and as anchor for various brackets for ropes, plates etc. in various positions.

Finally, it is expedient for the various parts to be made of suitable materials, not only from the construction point of view but also for reasons of visual appearance.

BRIEF DESCRIPTION OF THE DRAWINGS

Example embodiments of the invention will now be described in more detail with reference to the drawings, where.

DESCRIPTION OF THE EXAMPLE EMBODIMENTS

Figure 1:
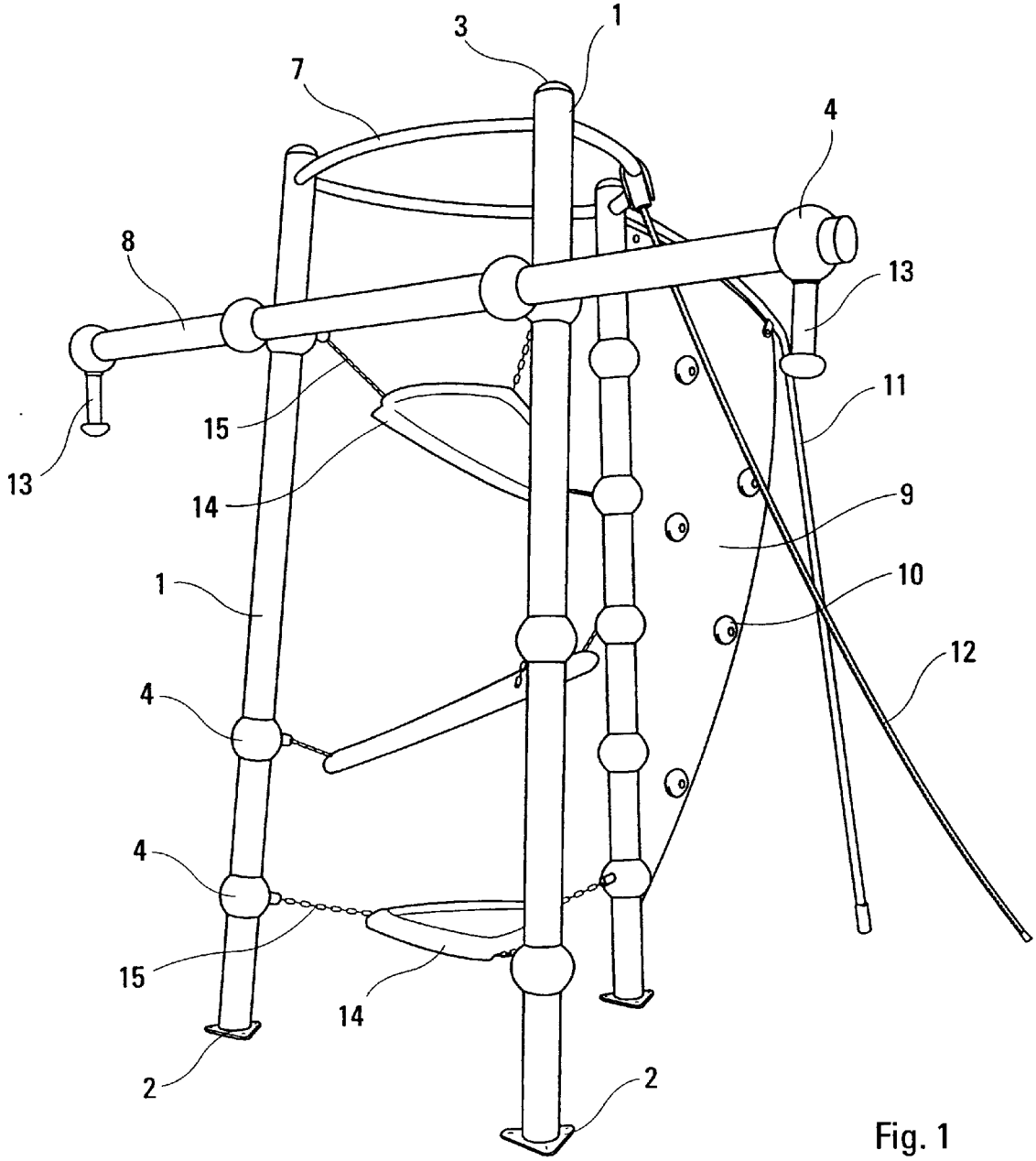
FIG. 1 shows an example embodiment of the equipment comprising, among other things, a climbing wall and a cross-beam.

The following is a description of the example embodiments:

The first example is shown in FIG. 1.

As will be seen from the drawing, the playground equipment comprises a tower construction consisting of three tubular metal columns 1, which have feet 2 which can be secured to a not-shown foundation base.

Figure 5:
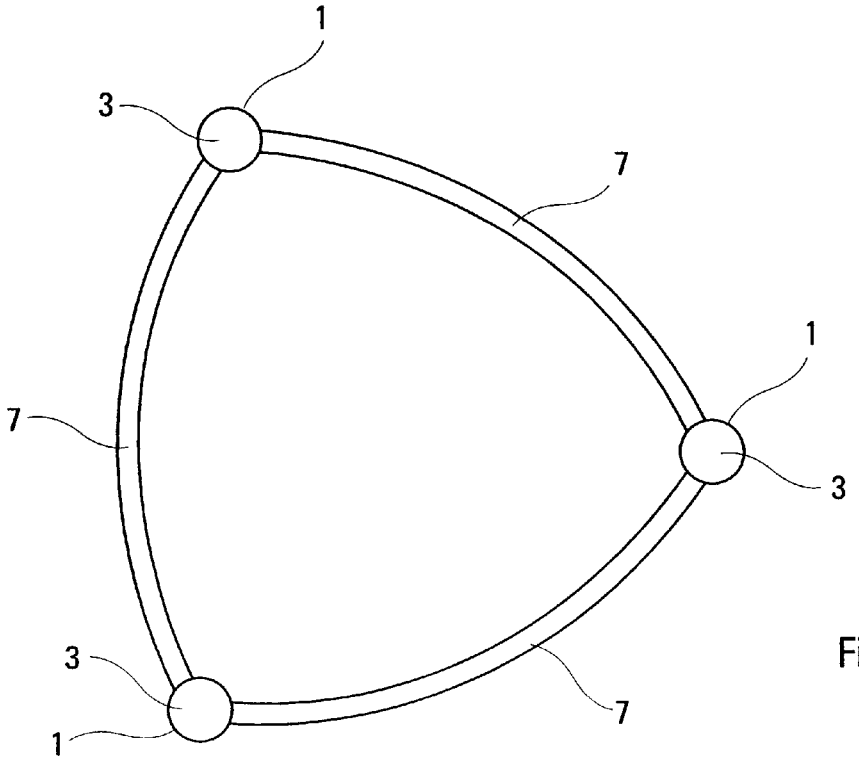
FIG. 5 shows the columns in the playground equipment seen from above.

At the top, the columns 1 are connected to connection tubes 7, which can also be seen in FIG. 5. At the top, the ends of the columns are provided with closing-plugs 3 or similar end-closing elements.

The columns 1 are placed in the corners of an equal-sided triangle, the sides of which are slightly larger at the bottom than at the top. This gives the tower a slightly tapered shape, which visually makes the tower "larger" and at the same time provides a good stability.

On the outer side of the one column 1 there is mounted a plate 9, on both sides of which a number of projections 10 are secured so that the plate can serve as a kind of climbing wall. In order to ensure the stability, there can also be mounted one or more support legs in the form of a metal stay 11 which extends from the top of the column and over the top of the plate down to a securing element in the base.

At the top of the two other columns there is mounted a cross-beam 8, the ends of which are covered with plugs 3 or similar closures 5, said ends also being provided with hand-grips 13.

Furthermore, a rope 12 is suspended from one of the connection tubes 7.

Finally, two platforms 14 in the form of plastic duckboards are suspended between the columns 1, said plates sloping in different directions as will be seen from the drawing.

Both of these plates 14 are suspended in slings 15, which can be either chains or plastic straps.

Figure 7:
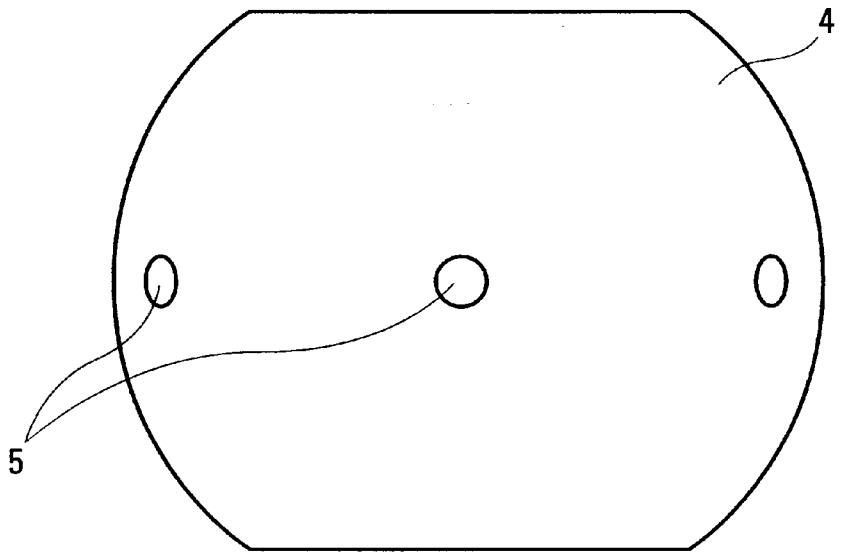
Figure 8:
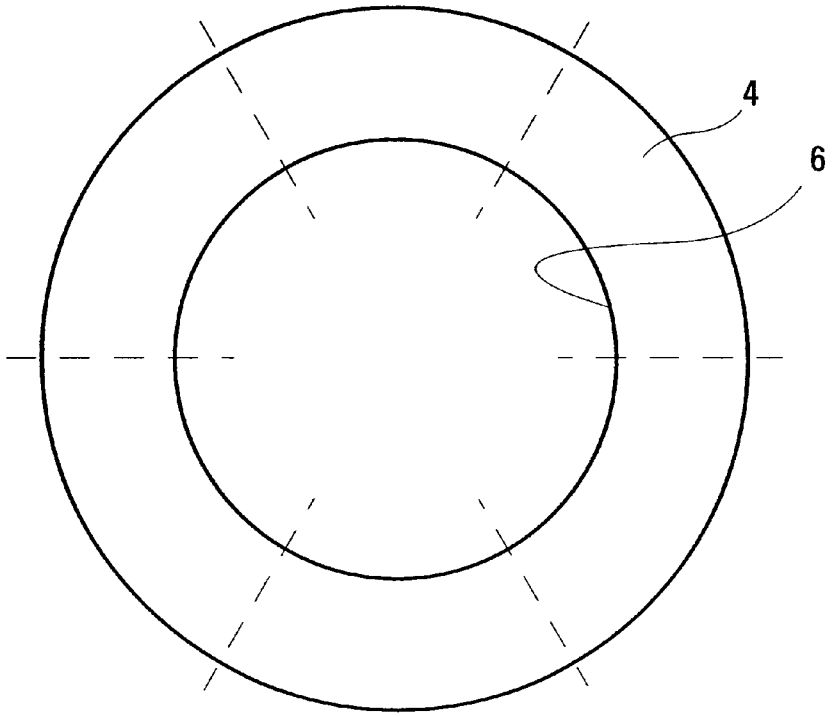

The above-mentioned accessory elements are all mounted by means of an assembly element which is shown in FIGS. 7 and 8.

This assembly element or bracket comprises a ring 4 which can be built up of one or more parts, and it has a through-going hole 6 which corresponds to the diameter of the column and which can be about 10 cm.

As will be seen in FIG. 7, the ring 4 is a part of a ball socket, and a number of threaded holes 5 extend through the ring as indicated by the stippled line in FIG. 8.

Figure 9:
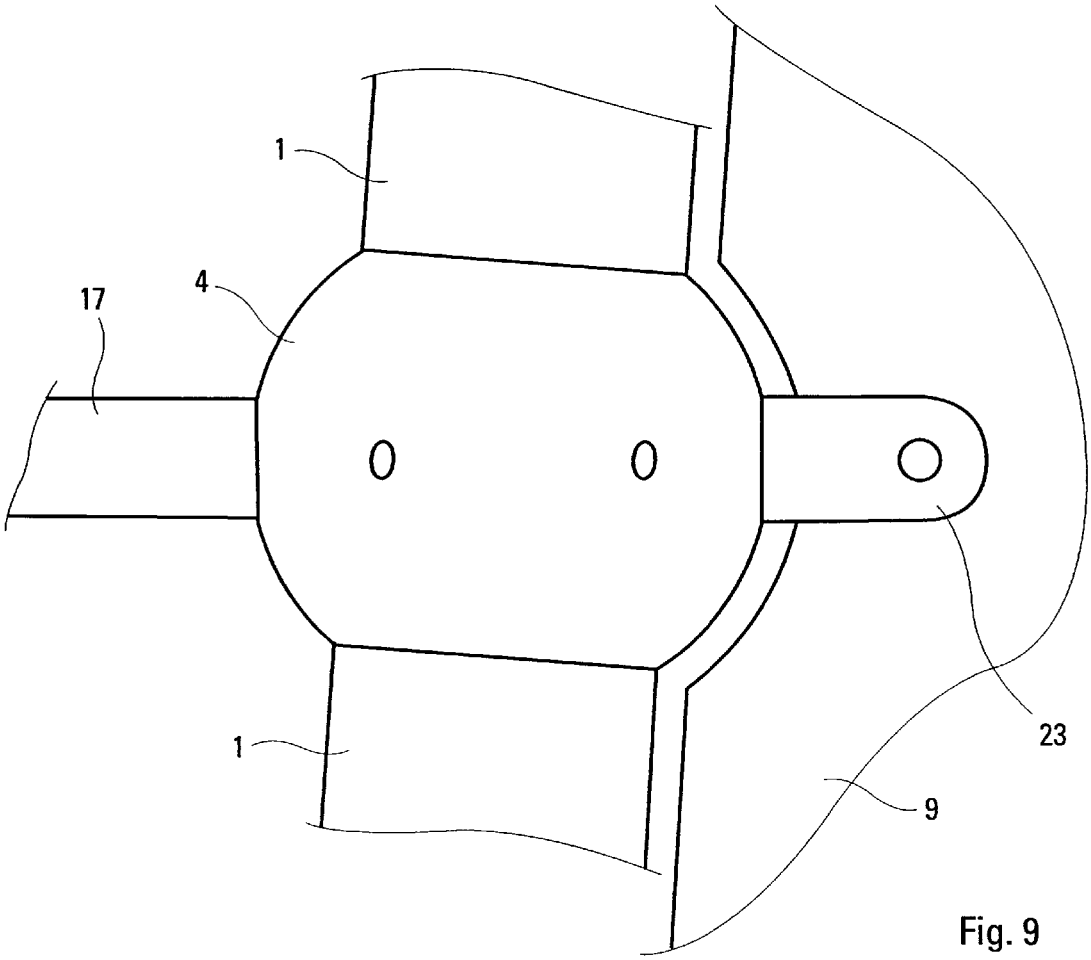
FIG. 9 shows an example of the mounting of plates on a column by means of the assembly brackets.

Bolts can be screwed into the threaded holes 5 so that the bracket can be fastened to a column 1, as for example shown in FIG. 9.

Moreover, brackets can be mounted as indicated in FIG. 9, which shows a bracket 23 mounted and where a plate 9 is secured to said bracket 23.

In the opposite side of the assembly element 4, a horizontally-extending plate 17 is mounted by means of a bolt in engagement with the mounting hole 5.

All the parts in FIG. 1 are mounted by means of such elements or brackets 4, in that a double bracket is used to connect the beam 8 with the column 1, and where two brackets 4 are bolted together in a mutually turned position of 90°.

Figure 2:
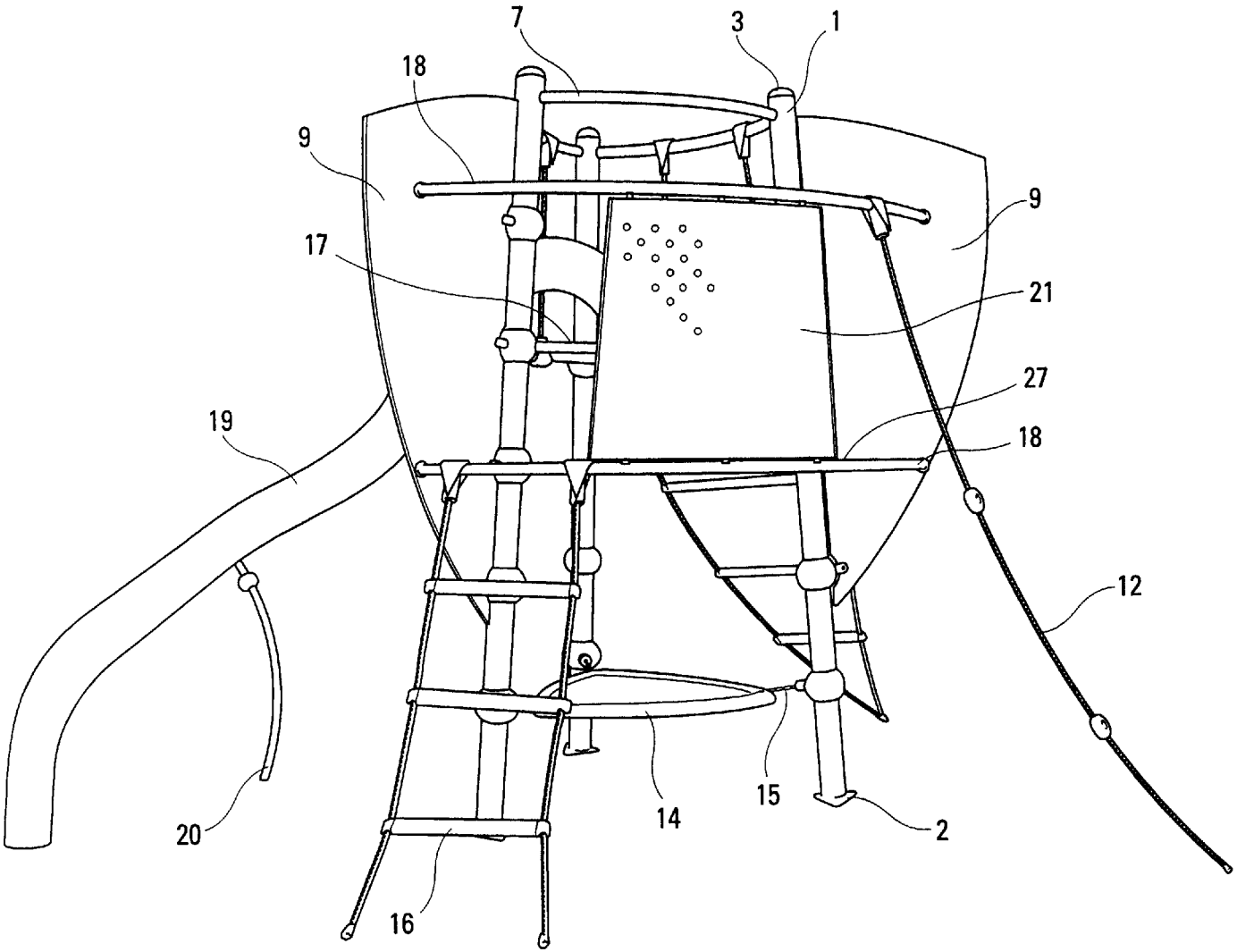
FIG. 2 shows an example embodiment comprising, among other things, a rope ladder and a climbing beam.

A second example embodiment is shown in FIG. 2.

The frame, consisting of the three columns 1, is further provided with an outer connection piece 18 which extends between two radially-extending shield-plates 9, in that each of said shield-plates is secured to the outer side of each column.

Figure 6:
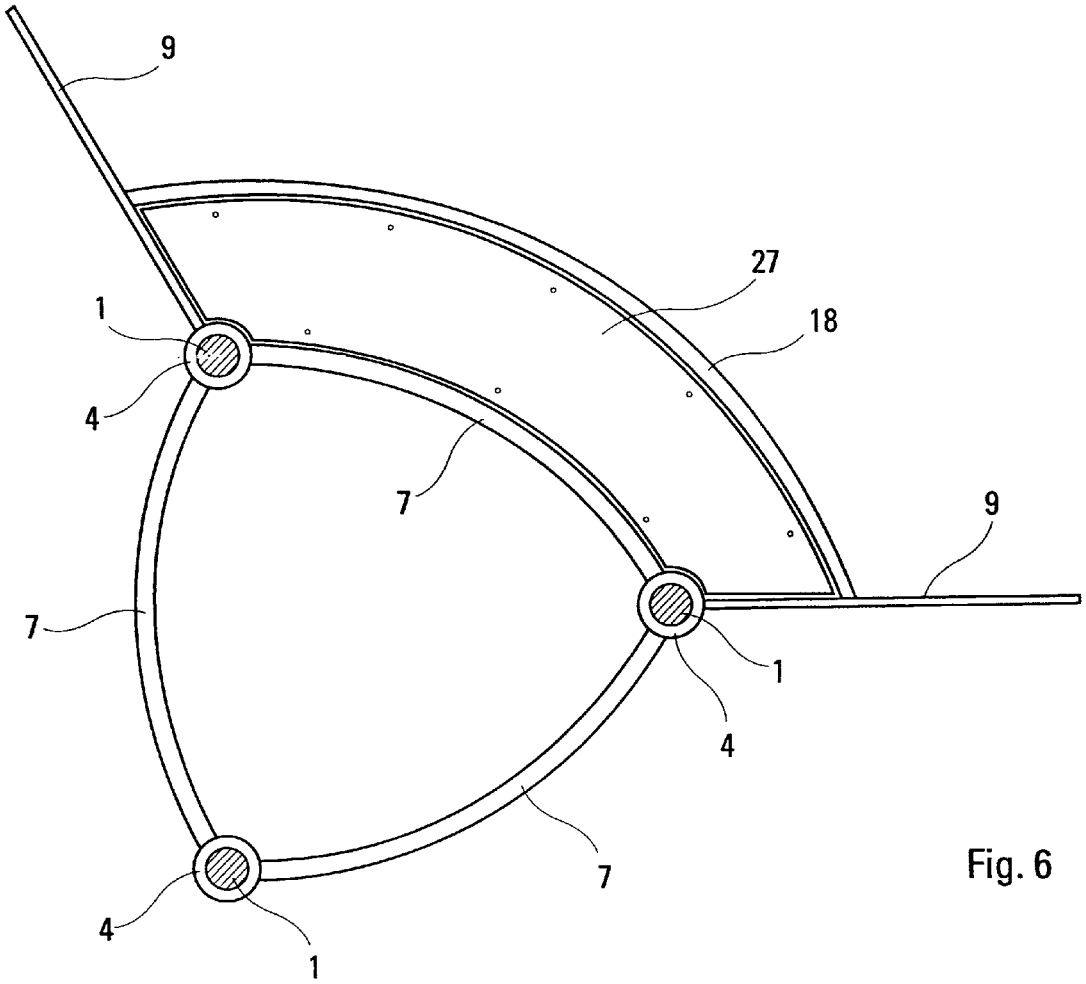
FIG. 6 shows a horizontal mid-section through the example embodiment shown in FIG. 1, FIGS. 7 and 8 show an assembly bracket seen from the side and the end.

This is shown in FIG. 6 in the form of a section view seen from above and down. As will also appear from the section view, there is also mounted a rigid duckboard 27.

A further outer connection piece 18 is provided at the top of the same columns, and between the two outer connection pieces 18 there is mounted a shield-plate 21 which can be perforated.

A fixed plate 17 is mounted between the columns in the middle of the tower, and suspended below this there is a plate 14.

On the fixed plate 17 there can also be mounted a climbing arrangement in the form of a rod-formed climbing beam 19, said arrangement extending in two arcs to the base. For the reinforcement of the beam 19, it can be mounted with a stiffening stay 20 which is secured to the base.

A rope ladder 16 and a rope 12 are also suspended.

Figure 3:
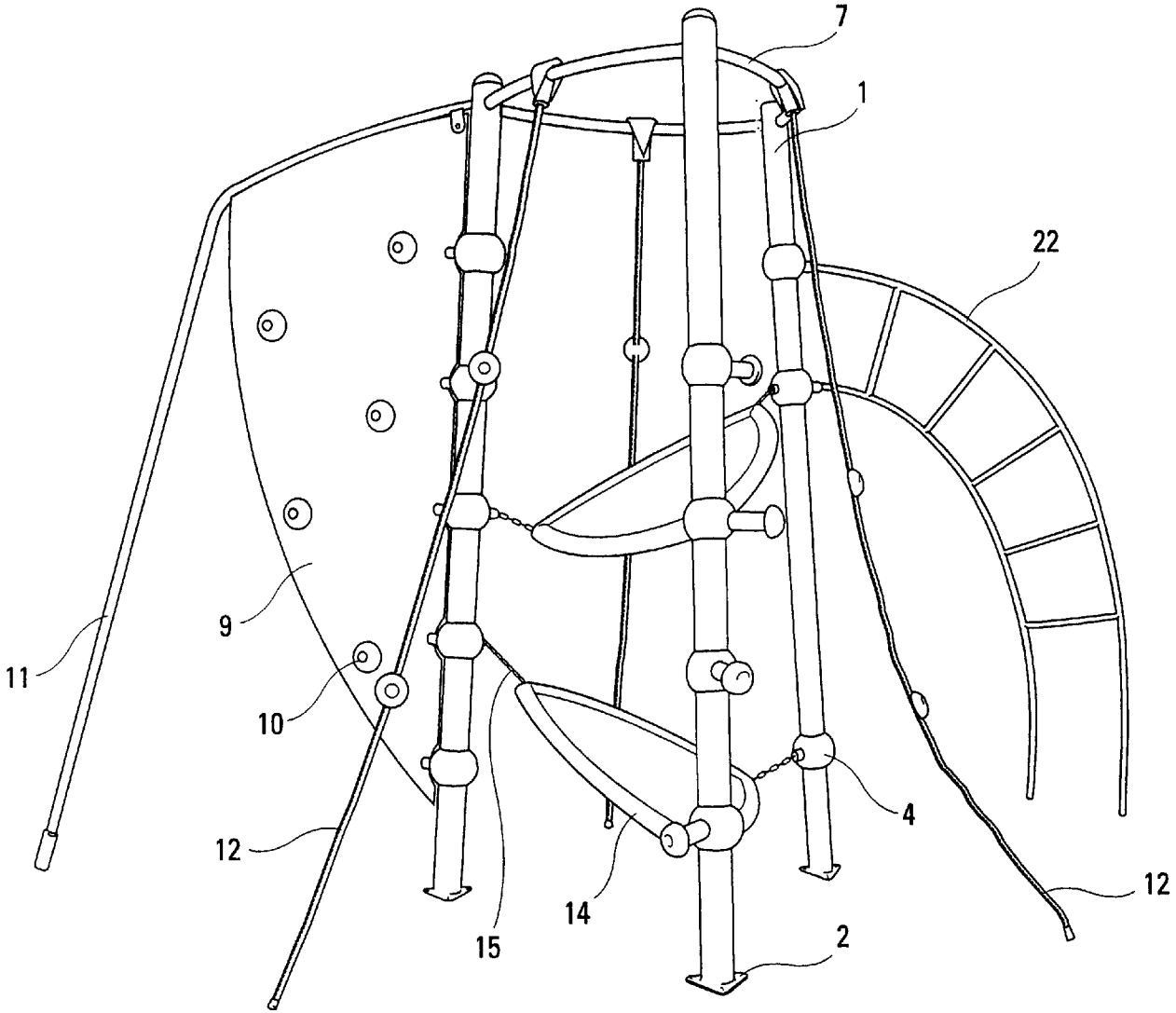
FIG. 3 shows an example embodiment comprising, among other things, a climbing wall and a ladder.

A third example embodiment is shown in FIG. 3.

Here, on the one column 1 there is mounted a climbing plate 9 with projections 10 and stiffening stay 11, and two plates 14 hung in an inclined manner in the suspension 15. There are also two ropes 12.

This corresponds to the first example embodiment shown in FIG. 1.

Additionally, on the one column there is mounted a metal ladder 22 with vertically-extending upper rung and side-pieces which extend in a twisting manner to form an arc downwards to the base where it forms a "normal" ladder.

Figure 4:
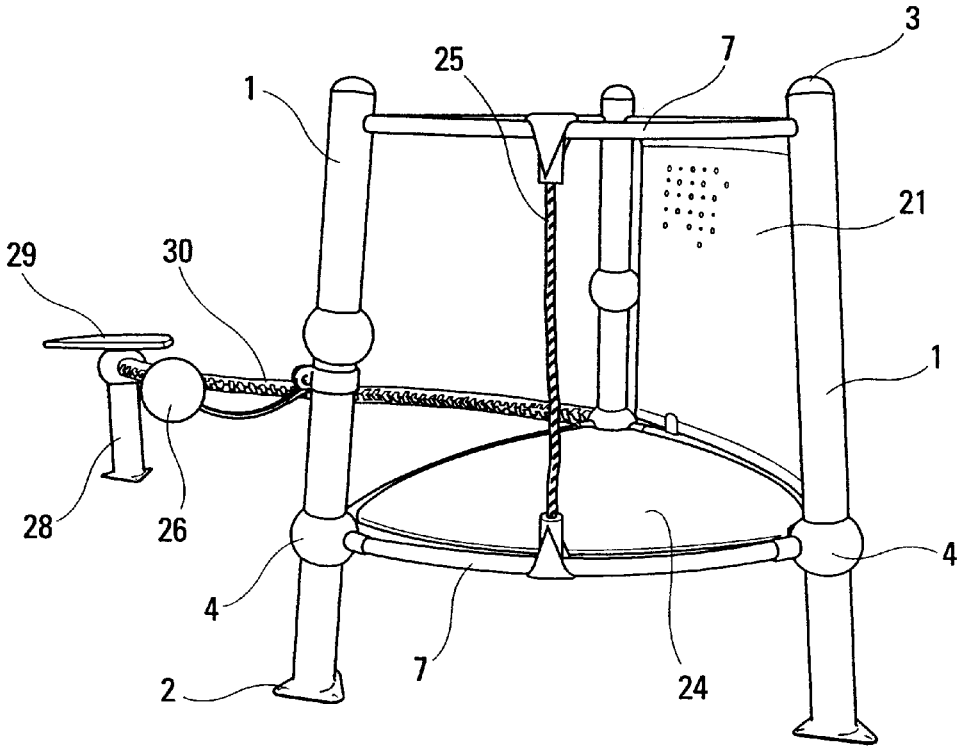
FIG. 4 shows an example comprising, among other things, a lower item of equipment with a balancing bar.

Finally, in FIG. 4 there is shown an example of a lower type of playground equipment comprising three shorter columns 1 with a fixed plate 24 secured to the lower connection tubes 7.

Between two of the connection tubes 7 lying above each other, there is also mounted a rope 25.

On this frame there is mounted a balancing beam 30 which, at its far end, is supported by a column 28 with a top-plate 29.

Finally, on the one column 1 there is mounted a rocker arrangement in the form of a ball 26 on a piece of spring steel or the like, and a perforated shield-plate 21 corresponding to the shield-plate which was discussed in connection with the second example embodiment shown in FIG. 2.

For the production of the individual parts of which the playground equipment consists, use is made of suitable materials such as steel and/or alloy for the columns 1, the ladder 22 and the beam 8, while the plates 9, 17 are preferably made of a suitable wooden plate which can be a laminate or other suitable furniture plate.

The platform 14 and the assembly element 4 are preferably made of a suitable plastic, which is strong and herewith ensures that the playground equipment is supported and held together in a secure and stable manner.

What is claimed is:

1. Playground apparatus which may be anchored to a base, the playground apparatus comprising:

three upright tubular columns, each having a bottom end located a common distance from each other column bottom end, each column having a top end, each column extending in an upward and inward direction such that the top ends are at a reduced common distance relative to the bottom ends, means for interconnecting the three columns to provide a stable and strong triangular cross-sectional structure defining an inner play area, one or more playground elements secured to the triangular structure, one playground element being a plate element secured to the triangular structure by being secured to an outer side surface of at least one column, the plate element extending outwardly from and vertically along the outer side surface of the at least one column.

2. The playground apparatus of claim 1 wherein the connecting means comprise at least one tubular connection piece extending horizontally and being attached to at least the top ends of each column.

3. The playground apparatus of claim 2 further comprising a second tubular connection piece extending horizontally and being attached to each column.

4. The playground apparatus of claim 1 wherein the plate element has projections for climbing.

5. The playground apparatus of claim 1 further comprising at least one substantially horizontal plate attached to each column within the triangular structure.

6. The playground apparatus of claim 5 wherein the plate is suspended by at least one chain or rope attached to the columns.

7. The playground apparatus of claim 1 further comprising at least one plate attached to each column within the triangular structure, the plate being inclined within the triangular structure.

8. The playground apparatus of claim 1 further comprising a plate fixed within the triangular structure, a rod formed climbing beam connected at one end to the fixed plate, the beam extending downwardly to the base.

9. The playground apparatus of claim 1 further comprising a metal ladder mounted to at least one column, the ladder having sidewalls with rungs therebetween, the sidewalls secured to an upper portion of the column, one sidewall secured above the other sidewall such that an upper rung extends vertically, the ladder extending downwardly in an arc in a twisting manner, a bottom end of the ladder having horizontally extending rungs.

10. The playground apparatus of claim 1 further comprising an assembly element having a through hole for receiving a column therein, the element slidable over the column and being secured to the column by fastener means.

11. The playground apparatus of claim 10 wherein the assembly element further comprises mounting brackets for securing playground elements thereto.

12. The playground apparatus of claim 1 wherein the columns are made of metal.

13. The playground apparatus of claim 1 wherein the playground apparatus is composed of materials selected from the group consisting of metal, wood and plastic.

14. The playground apparatus of claim 1 further comprising a cross-beam attached to an upper portion of two columns.

15. A playground apparatus which may be anchored to a base, the playground apparatus comprising:

three upright tubular columns, each having a bottom end located a common distance from each other column bottom end, each column having a top end, each column extending in an upward and inward direction such that the top ends are at a reduced common distance relative to the bottom ends, means for interconnecting the three columns to provide a stable and strong triangular cross-sectional structure defining an inner play area, one or more playground elements secured to the triangular structure, a metal ladder mounted to at least one column, the ladder having side walls with rungs therebetween, the side walls secured to an upper portion of the column, one side wall secured above the other sidewall such that an upper rung extends vertically, the ladder extending downwardly in an arc in a twisting manner, a bottom end of the ladder having horizontally extending rungs.

16. The playground apparatus of claim 15 wherein the connecting means comprise at least one tubular connection piece extending horizontally and being attached to at least the top ends of each column.

17. The playground apparatus of claim 16 further comprising a second tubular connection piece extending horizontally and being attached to each column.

18. The playground apparatus of claim 15 further comprising a plate element secured to the triangular structure, the plate element having projections for climbing.

19. The playground apparatus of claim 15 further comprising at least one substantially horizontal plate attached to each column within the triangular structure.

20. The playground apparatus of claim 19 wherein the plate is suspended by at least one chain or rope attached to the columns.

21. The playground apparatus of claim 15 further comprising at least one plate attached to each column within the triangular structure, the plate being inclined within the triangular structure.

22. The playground apparatus of claim 15 further comprising a plate fixed within the triangular structure, a rod formed claiming beam connected at one end to the fixed plate, the beam extending downwardly to the base.

23. The playground apparatus of claim 15 further comprising an assembly element having a through hole for receiving a column therein, the element slidable over the column and being secured to the column by fasteners.

24. The playground apparatus of claim 23 wherein the assembly element further comprises mounting brackets for securing playground elements thereto.

25. The playground apparatus of claim 15 wherein the columns are made of metal.

26. The playground apparatus of claim 15 wherein the playground apparatus is composed of materials selected from the group consisting of metal, wood and plastic.

27. The playground apparatus of claim 15 further comprising a cross-beam attached to an upper portion of two columns.

* * * * *